United States Patent [19]

Castel

[11] 4,207,022

[45] Jun. 10, 1980

[54] POWERED VEHICLE FOR LOADING, TRANSPORTATION AND UNLOADING OF HEAPED MATERIALS

[75] Inventor: Claude Castel, Herblay, France

[73] Assignee: COVEM - Compagnie de Vente d'Engins Mecaniques, Epinay-Surorge, France

[21] Appl. No.: 915,420

[22] Filed: Jun. 14, 1978

Related U.S. Application Data

[63] Continuation of Ser. No. 692,819, Jun. 4, 1976, abandoned.

[30] Foreign Application Priority Data

Jun. 9, 1975 [FR] France ..... 75 17964

[51] Int. Cl.[2] ..... E02F 3/28

[52] U.S. Cl. ..... 414/685; 298/22 R

[58] Field of Search ..... 214/350, 352, 140, 774, 214/768, 147 R; 298/22 R, 17 R; 414/469, 487, 551, 553, 554, 743, 697, 699, 705, 715, 685

[56] References Cited

U.S. PATENT DOCUMENTS

| | | | |
|---|---|---|---|
| 2,350,488 | 6/1944 | Barrett | 298/22 |
| 3,651,971 | 3/1972 | McGuinness | 214/768 |
| 3,794,191 | 2/1974 | Kuhn | 214/774 |
| 3,974,926 | 8/1976 | Kopaska | 214/352 |
| 3,985,250 | 10/1976 | Mononen | 214/147 R |

FOREIGN PATENT DOCUMENTS

| | | | |
|---|---|---|---|
| 837871 | 6/1960 | United Kingdom | 298/22 R |

*Primary Examiner*—Stephen G. Kunin
*Assistant Examiner*—Lawrence E. Williams
*Attorney, Agent, or Firm*—Pollock, Vande Sande & Priddy

[57] ABSTRACT

A powered vehicle for loading, transporting and unloading heaped materials comprises a chassis having a first fixed part mounted on running gear and a second movable part pivotally mounted on the front of the fixed part which is substantially vertically aligned with the front axis of rotation of the running gear, the front of the movable part projecting beyond the front of the fixed part and having pivotally mounted on it a skip. The skip is moved between loading, transportation and unloading positions by two elements, one of which bears on the fixed and movable chassis parts for pivoting the movable chassis part relative to the fixed chassis part and the other of which bears on the movable chassis part and the skip for pivoting the skip relative to the movable chassis part.

4 Claims, 6 Drawing Figures

POWERED VEHICLE FOR LOADING, TRANSPORTATION AND UNLOADING OF HEAPED MATERIALS

This is a continuation of application Ser. No. 692,819, filed June 4, 1976, now abandoned.

This invention relates to powered vehicles for loading, transportation and unloading of heaped materials such as sand, earth, gravel, aggregates, etc.

At the present time there are various vehicles used for the above operations. The simplest is a power barrow comprising a pivoting hopper for the loading, transportation and unloading of heaped materials. Because of its efficacy, small dimensions and modest costs, this vehicle enjoys considerable commercial success but nevertheless has a disadvantage inasmuch as the operator standing on the ground has to exert considerable physical force to pivot the barrow about its axle to allow the hopper to be loaded.

In contrast to this small vehicle, there are more complex ones provided with a scoop or bucket at the end of a pivoting arm. In this case, the operator drives the vehicle from a cab and no physical effort is required of him. This type of vehicle using a pivoting arm and bucket also has the advantage of allowing the bucket to be unloaded at a higher level than ground level, for example into the skip of a lorry or dumper. On the other hand, it has numerous disadvantages due to the distance between the load in the bucket at the end of the pivoting arm and the chassis bearing the cab. To balance the vehicle and prevent its tilting, a large counterweight has to be provided for the pivoting arm with the result that the vehicle weight is generally increased so that, unless special precautions are taken, it cannot be used on fragile ground, e.g., a tennis grass court, etc., and the power requirements of such a vehicle are also increased. Obviously the cost of such a vehicle does not bear comparison with that of the above-mentioned power barrow.

Finally, there is the dumper vehicle which comprises a hopper or skip mounted pivotally on a chassis provided with running gear and driven by a seated driver, as is also the case with the vehicles employing a pivoting arm and bucket. This third type of vehicle does not have the disadvantages of the vehicle employing the pivoting arm and bucket, because the position of the load is not such as to require a large counterweight, nor does it have the disadvantages of the power barrow because it requires no physical effort by the operator. However, it only allows the transportation and unloading of materials. The skip has to be loaded manually or by means of another vehicle.

Finally, there is a vehicle like the dumper vehicle but which can be used for loading. Loading is possible because the skip is mounted on a two-part chassis, one fixed part of which is supported by the vehicle running gear while the other movable part is mounted pivotally on the front end of the fixed part and its front end projects beyond the front end of the fixed part. The base of the skip rests on the movable chassis part and is pivotally mounted on the front end of the movable part. With this arrangement the skip can be pivoted about two separate axes depending upon whether loading (pivoting of the movable chassis part about the fixed part) or unloading (pivoting of the skip about the front end of the movable part which is locked relative to the fixed part) is being carried out. The control means for this vehicle comprise a first element acting gradually on the skip and a second element which operates on the two-step action principle. This second element, which acts on the movable chassis part, is in fact a simple locking device.

With such a system, the skip can carry out only two types of movement, forward and return, the path of which is fixed once and for all by the design.

It would be desirable to be able to select the skip path, for example, in order to unload the skip at the required height from the ground, more particularly on to an existing pile of material or, alternatively, into a trench, or to load at or below ground level, i.e., to dig if the ground is loose. From this aspect, the above vehicle with a two-part chassis is not satisfactory.

Another disadvantage of this vehicle is due to the fact that the front end of the fixed chassis part projects distinctly beyond the vertical extending through the front running axis of the vehicle. Consequently, the skip and hence the load are forwardly offset and a large counterweight has to be provided at the rear of the vehicle to prevent tilting. The vehicle with the two-part chassis therefore has the same drawbacks as the vehicle with the pivoting arm and bucket (weight, increased power requirements, and increased cost), although to a lesser degree.

It is an object of this invention to provide a vehicle which, unlike the power barrow, requires no physical exertion on the part of the operator; unlike the pivoting arm and bucket loader and the two-part chassis vehicle, can be light and require only a low power; unlike the dumper, allows the three operations of loading, transportation and unloading to be carried out; and, unlike the two-part chassis vehicle, allows the skip to perform movements over different paths.

This object is achieved by the powered vehicle according to the invention.

It will be appreciated that in the description and in the claims the expressions "front of the vehicle," "front axis of rotation of the running gear," and "front" refer to that zone of the vehicle which is situated "at the front" in the loading position.

The "front" is relative, because the vehicle may be moved in a manner known per se in two different directions depending upon whether it is "working" or travelling on the road in the same way as any other vehicle.

The vehicle according to the invention is characterized by a combination of features, namely the position of the front of the fixed chassis part and the arrangement and properties of the control means acting directly or indirectly on the skip.

With regard to the first of these features, it has been recognized that in order to do away with the need for a larger counterweight the load must be as close as possible to the chassis supported by the running gear. The limit to this juxtaposition is the axis of rotation of the running gear, in other words the axle in the case of wheels. The ideal, therefore, is for the skip to pivot about an axis which is practically straight above the front axis of rotation of the running gear.

With a two-part chassis as indicated above, and if this relative position of the front end of the fixed chassis part and the axis of rotation of the front running gear is observed, the resultant vehicle weighs about 300 kg, for example, given a 200 to 250 liter skip capacity. By contrast, for a 200 liter bucket, capacity the pivoting arm and bucket type of vehicle is more than 1 ton.

Because of its light weight and its compact structure, a vehicle according to the invention requires only a low power, thus reducing its operating cost.

With regard to the second of the above features, i.e., the arrangement and properties of the control means, this feature enables the skip movements to be carried out ad infinitum by separately or simultaneously actuating the two control elements both of which have a gradual action. These control elements may have any suitable form. They may be mechanical means, e.g., rack systems, or hydraulic or pneumatic means such as jacks. Hydraulic jacks are preferably used.

The vehicle also advantageously comprises means for controlling the speed of pivoting of the movable chassis part to provide a slow tipping of the skip forwardly for loading with a relatively sharp return movement of the skip into its transportation position.

The slow rate of skip descent is particularly important when the skip is already partially loaded and is re-lowered to complete the load. An abrupt descent of the skip half-laden would in fact risk unbalancing the vehicle.

On the other hand, it is advantageous for the skip lifting movement to be abrupt because this will result in the load being jerked, so that it moves away from the skip leading edge and allows a fresh loading operation to complete the filling of the skip.

These means for controlling the speed of pivoting of the movable chassis part may advantageously comprise a flow reducer in the case in which hydraulic jacks are used.

The invention will be more fully understood from the following description of an embodiment thereof given by way of example only, with reference to the accompanying drawings.

Figure 1:
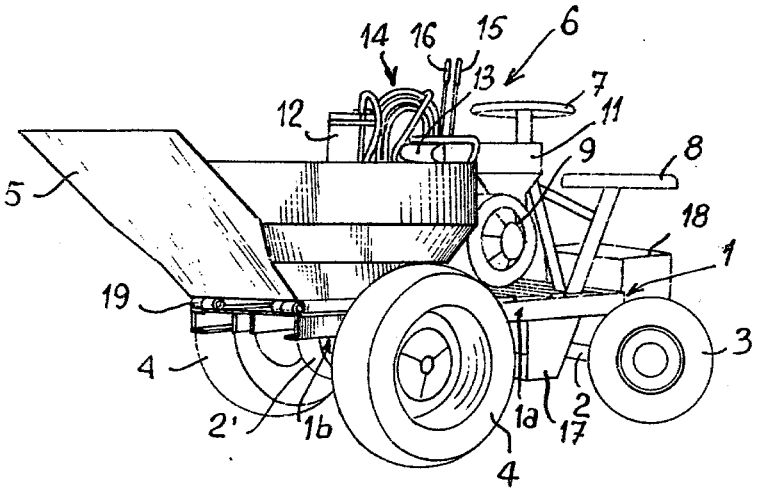
FIG. 1 is a perspective view of an embodiment of a vehicle in the transportation position.
Figure 3:
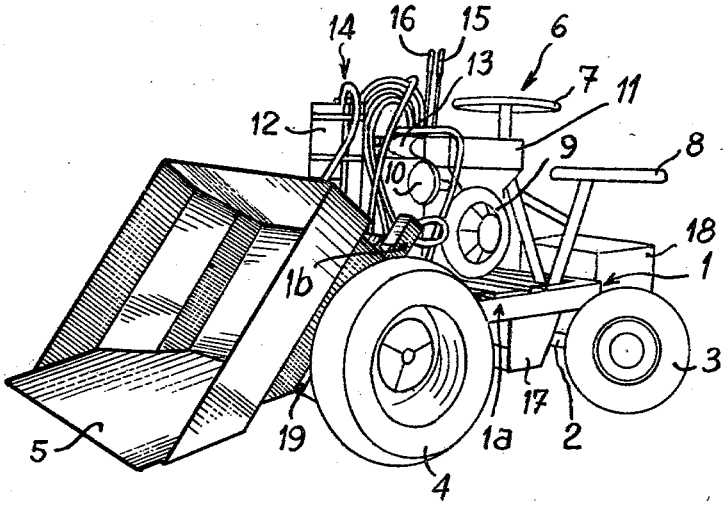
FIG. 3 is a perspective of the vehicle in the loading position.
Figure 5:
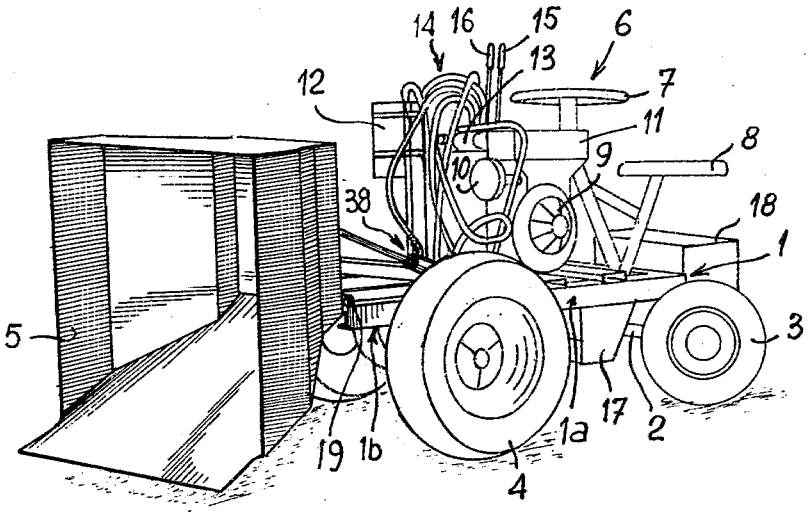
FIG. 5 is a perspective view of the vehicle in the unloading position.

Referring to FIGS. 1, 3 and 5, there is illustrated a vehicle comprising a chassis 1 provided with two axles 2 only one of which is visible which respectively bear two rear wheels 3 and two front wheels 4, and include differential gears 2, only one of which is visible.

Chassis 1 also carries a skip 5 and a driver's control station 6, of which only the steering wheel 7, driver's seat 8, engine 9, silencer 10, fuel tank 11, a hydraulic control circuit comprising a fluid tank 12, a distributor 13, connecting pipes 14, and control levers 15 and 16 are shown. It will also be seen that chassis 1 is reinforced by a gusset 17, and that it is provided with a counterweight 18 at the rear. Skip 5 is mounted pivotally by means of hinges 19 on the front end of the chassis 1.

Figure 2:
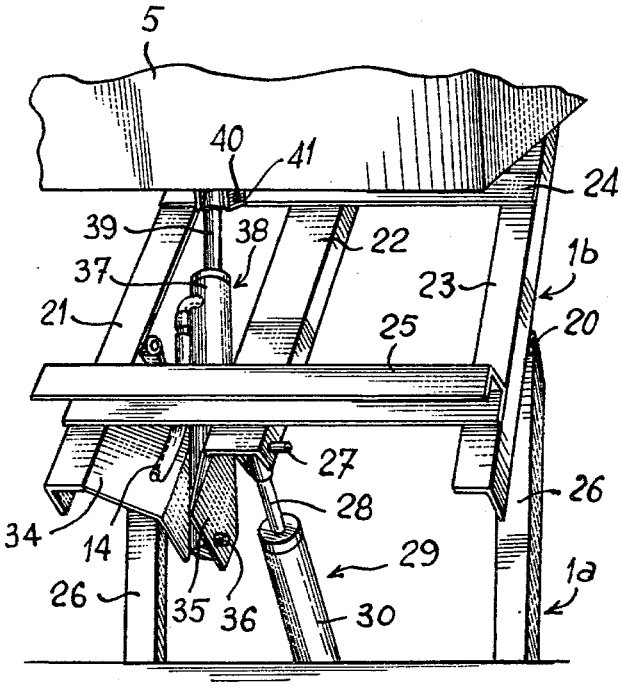
FIG. 2 is a partial top plan view of the vehicle of FIG. 1.

Referring to FIG. 2, chassis 1 is formed by two parts 1*a* and 1*b*. Chassis part 1*a* is fixed and carries the running gear 3, 4 and control station 6. Chassis part 1*b* is mounted pivotally by means of suitable hinges 20 at the front end of chassis part 1*a*. The base of skip 5 rests on the movable chassis part 1*b*. The skip is shown in the raised position in FIG. 2.

It will also be seen from FIG. 2 that the movable chassis part 1*b* is formed by three longitudinal angle-sections 21, 22 and 23 and two transverse angle sections 24 and 25.

Figure 4:
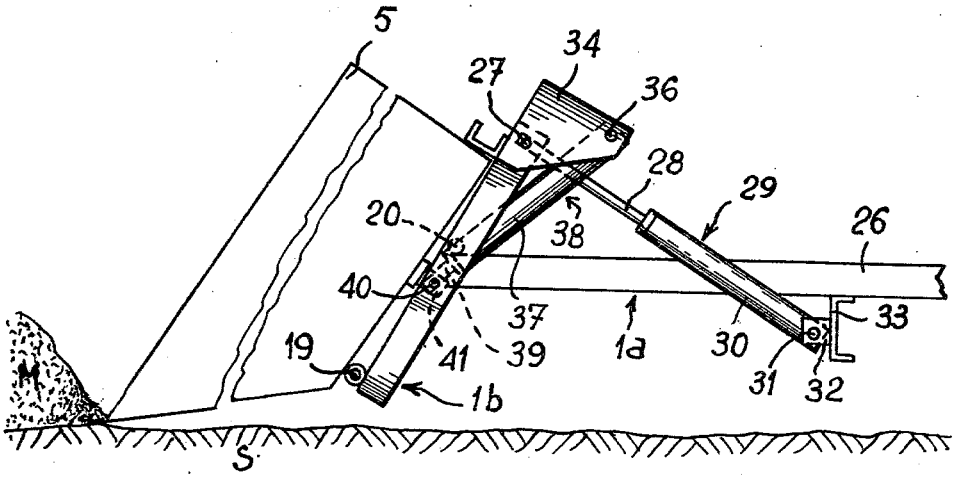
FIG. 4 is a partial diagrammatic section corresponding to FIG. 3.

The angle sections 21 and 23 have an L-shaped section so that they can fit over the longitudinal members forming the sides of the fixed chassis part 1*a*. Angle section 22 is U-shaped. It will be seen that a spindle 27 extends through the flanges of the rear end of the angle section 22. Rod 28 of a hydraulic jack 29 is pivotally mounted on the spindle 27. Referring to FIG. 4, for example, cylinder 30 of jack 29 is also pivotally mounted about a pivot 31 mounted on a U-bracket 32 connected to a transverse angle section 33 which is in turn secured to the fixed chassis part 1*b*.

Referring again to FIG. 2, cheeks 34, 35 respectively are mounted on each of the angle sections 21, 22 of the movable chassis part 1*b* and carry a spindle 36. Cylinder 37 of a second jack 38 is mounted on this spindle 36 and the rod 39 thereof is mounted to pivot about a spindle 40 which is in turn mounted in a U-bracket 41 connected to the base of the skip 5.

The machine operates as follows:

In the position of transport, the vehicle is as shown in FIG. 1. In other words, the base of skip 5 bears on the movable chassis part 1*b* which in turn bears on the fixed chassis part 1*a*. The jack rods 28 and 39 are thus retracted in the corresponding cylinders 30, 37.

The operator sitting on seat 8 can drive the vehicle conventionally. Preferably, he will have two forward speeds in addition to reverse, one of the forward speeds providing a relatively fast movement for transportation while the other provides a slower movement for advancing the vehicle during loading.

For loading, the operator actuates lever 15 of the hydraulic circuit, so that rod 28 extends from jack 29. As it bears on the longitudinal angle section 22, rod 28 of jack 29 causes the movable chassis part 1*b* and the skip 5 that it supports to pivot about the hinges 20 as will be clearly seen from FIG. 4. The vehicle is then in the position shown in FIG. 3. Extension of the rod 28 of jack 29 is accompanied by pivoting of the jack 29 itself about the pivots 27 and 31.

The driver then selects the slow speed and drives the leading edge of the skip 5 flush with the ground S into the pile of material M to be loaded. When the skip 5 is half full, the operator raises it by returning the control lever 15 to its initial position, so that rod 28 of jack 29 is retracted again. Raising of the skip 5 is fairly abrupt, so that the load is shaken to the rear and the leading edge of the skip 5 is freed. The operator reverses the vehicle if necessary, and then re-lowers the unit comprising the skip and the movable chassis part, as described hereinbefore. Unlike the raising movement, the lowering movement is progressive in order to prevent the laden skip from unbalancing the vehicle, and this progressive movement is obtained by means of a flow reducer on the hydraulic circuit. The flow reducer may be a conical throttle formed with passages for the fluid and containing a ball adapted to abut against at least some of the passages when the fluid flows in the direction corresponding to extension of the rod 28 of the jack 29. After the skip 5 has again engaged the pile of material by its leading edge and the unit consisting of the skip 5 and the movable chassis part 16 has been lifted again, the loading operation is complete.

The operator reverses the vehicle, then selects a forward fast speed and transports the load to the required place (vehicle in the position shown in FIG. 1).

Figure 6:
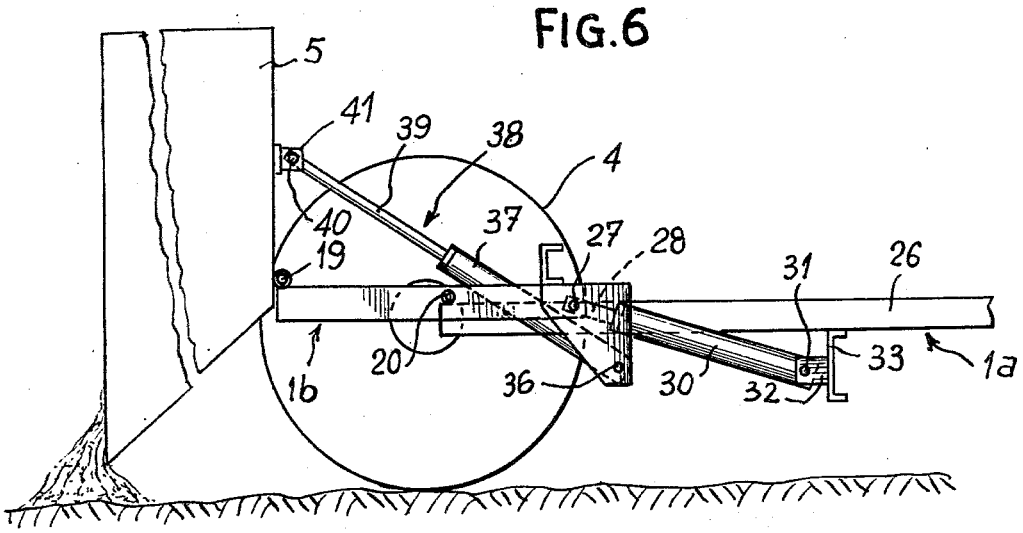
FIG. 6 is a partial diagrammatic section corresponding to FIG. 5.

For unloading purposes, the operator actuates the hydraulic circuit control lever 16, so that rod 39 of jack 38 is extended. As it bears on the base of the skip 5, the rod 39 of jack 38 causes the skip to be pivoted about the hinges 19, the movable chassis part 1*b*, remaining in contact with the fixed chassis part 1*a* as will be clear from FIG. 6. Extension of the rod 39 of jack 38 is accompanied by pivoting of the jack 38 itself about the pivots 36 and 40. The vehicle is then in the state shown in FIG. 5. The front wall of the skip is no longer substantially horizontal as in the case of loading, but extends obliquely downwards so that the skip can be completely unloaded.

It will be apparent from the foregoing description that the vehicle according to the invention has a remarkably compact structure as a result of the pivotability of the skip about two different pivots. At every stage of operation, the load always remains near the axis of the front wheels, so that there is no need to balance the vehicle by providing it with a larger counterweight. Although the vehicle is provided with a counterweight, its weight (about 50 kg) is much less than those used on vehicles of the pivoting arm and scoop type.

The present invention is not intended to be limited to the above described embodiment. More particularly, the skip could be pivotable about two pivots by providing an arrangement other than a two-part chassis. For example, the skip could be mounted on a single spindle displaceable by a translatory movement between two positions. Also, although the drawings show a wheel-mounted vehicle, the running gear could be different, for example in the form of caterpillar tracks.

Again, instead of providing a flow reducer of the type described in the hydraulic circuit, a two-speed jack could be used, for example, of the type available commercially.

The jacks could be mounted the other way round: in other words, the cylinder 30 (or 37) of jack 29 (or 38) could be pivotable about pivot 27 (or 40) and the rod 28 (or 39) of the same jack could be pivotable about pivot 31 (or 36).

With regard to the way in which the vehicle is used, it is not essential that the skip be loaded in two operations as explained hereinbefore. Furthermore, although the jacks 29 and 38 will be operated alternately in most cases, they can be operated simultaneously (see FIG. 2) for certain operations, e.g., loading from a level above ground level.

What is claimed is:

1. A powered vehicle for unassisted loading, transporting and unloading heaped material, comprising (a) a chassis having a transverse shaft thereon and a relatively movable part comprising at least a supporting portion which rests substantially horizontally on said chassis in the transportation and unloading positions thereof and which is pivotally mounted on said transverse shaft;

(b) running gear;

(c) means for mounting said transverse shaft substantially directly above the front axis of rotation of said running gear, said movable part having a portion extending from said transverse shaft towards the front of said vehicle;

(d) means for driving and controlling said running gear;

(e) skip means having a front end wall upwardly diverging from the vertical axis thereof in said transportation position, and arranged with its base resting on said supporting portion of said movable part in one position thereof, said skip means being located adjacent the front end of said vehicle in its normal forward direction of movement;

(f) means pivotally mounting said skip means at the front of said supporting portion of said movable part;

(g) means for moving said skip means between loading and transportation positions, comprising an element for pivoting said movable part with said skip means thereon about the front of said chassis and said supporting portion of said movable part, whereby said front end wall of said skip means is brought to a loading position substantially parallel with the ground; and (h) means for moving said skip means between transportation and unloading positions, comprising an element for pivoting said skip means at most 90° about the front of said supporting portion of said movable part, while said supporting portion retains its horizontal position, and bearing respectively on said skip means and said supporting portion of said movable part, whereby said front end wall of said skip means is brought to an unloading position substantially downwardly sloping from the vertical.

2. A vehicle according to claim 1, wherein said first element is a hydraulic jack.

3. A vehicle according to claim 1 wherein said second element is a hydraulic jack.

4. A vehicle according to claim 1, comprising means for controlling the speed of pivoting of the movable chassis part.

* * * * *